US005318888A

United States Patent [19]

Weberg et al.

[11] Patent Number: 5,318,888

[45] Date of Patent: Jun. 7, 1994

[54] LARGE TABULAR GRAINS WITH NOVEL SIZE DISTRIBUTION AND PROCESS FOR RAPID MANUFACTURE

[75] Inventors: Elizabeth B. Weberg, Brevard; Clyde M. Huff, Jr., Flat Rock; Dennis C. Capps, Horse Shoe, all of N.C.

[73] Assignee: E. I. Du Pont de Nemours and Company, Wilmington, Del.

[21] Appl. No.: 946,865

[22] Filed: Sep. 16, 1992

[51] Int. Cl.[5] ..... G03C 1/015; G03C 1/005

[52] U.S. Cl. ..... 430/569; 430/567

[58] Field of Search ..... 430/567, 569

[56] References Cited

U.S. PATENT DOCUMENTS

| | | | |
|---|---|---|---|
| 4,400,463 | 8/1983 | Maskasky | 430/569 |
| 4,722,886 | 2/1988 | Nottorf | 430/569 |
| 4,797,354 | 1/1989 | Saitou et al. | 430/567 |
| 4,798,775 | 1/1989 | Yagi et al. | 430/569 |
| 4,801,522 | 1/1989 | Ellis | 430/569 |
| 4,914,014 | 4/1990 | Daubendiek et al. | 430/569 |
| 4,945,037 | 7/1990 | Saitou | 430/567 |
| 5,013,641 | 5/1991 | Buntaine et al. | 430/569 |
| 5,028,521 | 7/1991 | Grzeskowiak | 430/569 |

*Primary Examiner*—Charles L. Bowers, Jr.
*Assistant Examiner*—Mark F. Huff

[57] ABSTRACT

An improvement in tabular grain manufacture is provided wherein large tabular grains can be prepared in less time and with a narrower size distribution than available in the art. The improved process includes the steps of:

a) forming a nucleation solution by adding aqueous soluble silver salt to a vessel containing 0.08 to 0.25 molar aqueous soluble halide salt in an aqueous medium;

b) adding a solution of ammoniacal base to said nucleation solution when 0.30 to 9.0% of said soluble silver salt has been added;

c) optionally ripening said nucleation solution for up to 60 minutes;

d) adding said soluble silver salt to said nucleation solution preferrably at an increasing rate to obtain growth pBr of 1.3 to 2.3;

e) adding said soluble silver salt and said soluble halide salt to grow said tabular grains.

13 Claims, No Drawings

LARGE TABULAR GRAINS WITH NOVEL SIZE DISTRIBUTION AND PROCESS FOR RAPID MANUFACTURE

FIELD OF INVENTION

This invention is related to large tabular grains with novel size distribution and to the manufacture of such tabular grains particularly adopted for silver halide emulsions useful in photographic elements. A specific aspect of this invention relates to rapidly manufacturing large tabular grains with a narrow grain size distribution.

BACKGROUND OF THE INVENTION

The use of tabular silver halide grains in photographic emulsions, and the preparation thereof, have been widely known in the art. Tabular grains provide many advantages which have been well documented in the art. Generally, tabular grains are flat, silver halide grains that are prepared by employing long ripening times or a controlled salt addition such as provided by the balanced double jet (BDJ) method. The conventional tabular grain preparation procedure involves the steps of:

a) nucleation, wherein nuclei are formed upon which the grain will eventually grow;
b) an optional Ostwald ripening to dissolve the smaller nuclei and redeposit them on the larger, more stable nuclei;
c) growth, wherein additional silver salts and halide salts are added such that the nuclei formed during nucleation are grown to the desired size;
d) optional Ostwald ripening.

The increased demand for tabular grains has placed a burden on manufacturers to decrease the time required to manufacture tabular grains. This demand increases as the size of the tabular grain increases since a larger period of time is required during growth to add the precursor salts of silver and halide. Simply increasing the addition rate of the precursor salts, as advanced in U.S. Pat. No. 4,945,037, causes the formation of new nuclei during the growth phase which is undesirable. The nuclei formed during growth do not reach the same size as the grains which are grown upon the nuclei formed during the nucleation step. This undesirable growth of the newer nuclei requires a second Ostwald ripening after grain growth is completed to decrease the number of smaller grains. This extra processing step is undesirable due to the extra time involved and the inherent decrease in productivity.

Silver solvents such as ammonia have been taught in U.S. Pat. Nos. 4,727,886 and 4,801,522 to assist in the dissolution of small particles during Ostwald ripening, and to decrease the formation of new nuclei during grain growth. Specific process steps comprise a) adding silver nitrate at a bromide ion concentration of 0.08 to 0.25 N (pBr of 0.60 to 1.10);
b) adding a silver halide solvent, i.e. ammoniacal base, after at least 2% of the total silver solution is added;
c) optional halt, or Ostwald ripening, at a bromide ion concentration of 0.005 to 0.05 N (pBr of 1.30 to 2.30)
d) optional neutralization;
e) growth.

Furthermore, the addition of silver solution during the growth phase was maintained at a constant flow rate until the growth pBr was obtained. This approach works well if the rate of salt addition during growth is maintained at a relatively low rate of addition. At high levels of salt addition the salts mix to form new grain nuclei which grow as described above. If, during the growth phase, the rate of formation for new grain nuclei exceeds the rate of dissolution, multiple sizes of grains are produced. Some grains will be grown from the seeds formed during nucleation and smaller grains will be formed from the seeds formed during growth. The resulting emulsion may suffer in two ways. First, large size grains may not be obtained since there are more seeds competing for added salts. Second, the size distribution may suffer if the newer seeds do not reach the size of the particles intentionally formed during the initial nucleation phase. U.S. Pat. No. 5,028,521 further extends the growth period prior to ammonia addition wherein at least 20% of the silver is added prior to addition of the ammoniacal base. Increasing the amount of silver added prior to the addition of ammoniacal base does not correct the deficiency of the previous teachings.

The ability to form tabular grains in shorter time has been provided in U.S. Pat. No. 5,013,641 by addition of sodium hydroxide. To exploit the teachings, the initial seeding, or nucleation, must be done at a very low level of gelatin or peptizer. An additional step is then required wherein additional gelatin is added for growth. Furthermore, the nuclei formation must be accomplished with a dilute silver solution followed by growth with a concentrated silver solution. These extra process steps are highly undesirable.

There is an ongoing need in the art for a process for large tabular grain manufacture which can be accomplished in a short period of time without adversely affecting the size distribution of the grains and without increasing the number of process steps.

SUMMARY OF THE INVENTION

It is an object of the present invention to provide tabular silver halide grains which are larger than 1.0 $\mu m^3$ and which have a size distribution which is no more than 2.0 $V_{sig}g^o$. It is a further object of the present invention to provide a process for manufacturing tabular silver halide grains in a short period of time and without extra processing steps. These and other advantages, as will be apparent, are provided in a method for manufacturing tabular silver halide grains comprising the steps of:

a) forming a nucleation solution by adding aqueous soluble silver salt to a vessel containing 0.08 to 0.25 molar aqueous soluble halide salt in an aqueous dispersion medium
b) adding a solution of ammoniacal base to said nucleation solution when 0.30 to 9.0% by weight of said soluble silver salt has been added;
c) optionally ripening said nucleation solution for up to 60 minutes;
d) adding said soluble silver salt to said nucleation solution preferably at an increasing rate to obtain growth pBr of 1.3 to 2.3;
e) adding said soluble silver salt and said soluble halide salt to grow said tabular grains.

A preferred embodiment of the present invention is provided in manufacture of tabular silver halide grains useful in a photographic element wherein said tabular silver halide grains are at least 1.0 $\mu m^3$ with a size distribution of no more than 2.0 $V_{sig}g^o$; wherein formation of said tabular silver halide grains comprise the steps of:

a) forming a nucleation solution by adding aqueous soluble silver salt to a vessel containing an 0.08 to 0.25 molar aqueous soluble halide salt;

b) adding a solution of ammoniacal base to said nucleation solution when 0.30 to 9.0% by weight of said soluble silver salt has been added;

c) ripening said nucleation solution at a pBr level of no less than 0.780 and no more than 1.250;

d) adding said soluble silver salt to said nucleation solution at an increasing rate to obtain growth pBr of 1.3 to 2.3;

e) adding said soluble silver salt and said soluble halide salt to grow said tabular grain.

DETAILED DESCRIPTION OF THE INVENTION

The improved process for manufacturing tabular grains taught herein comprises the steps of nucleation, optional Ostwald ripening and growth. The tabular grains typically have an average thickness of about 0.05 to 0.5 mm and a mean aspect ratio of greater than 2:1, preferably greater than 5 to 1. Preferred tabular silver halide grains are silver bromide and silver iodobromide. Each step will be described in detail below.

A)Nucleation

A nucleation solution is a mixture of a dispersing medium and halide salt solution which are both introduced into a conventional reaction vessel equipped with a suitable stirring mechanism. The halide salt solution can be bromide, iodide, chloride or a mixture thereof. Bromide or greater than 50% by weight bromide is preferred. The discussion will focus on bromide for clarity but it is understood that the teachings herein apply to halide salts in general. Therefore in the discussion herein it is understood that although pBr levels are set forth, different halides are expressed as if they were Br and the concentration is thus set forth as pBr. The initial concentration of the halide is preferably 0.08 to 0.25 N (pBr=0.60 to 1.10) and more preferably 0.1 to 0.2 N (pBr=1.0 to 0.70). The halide salt is typically in the form of an aqueous salt solution such as sodium, potassium or an alkali earth metal such as magnesium or calcium. The temperature of the contents is typically maintained at 40° to 80° C. at a pH of 3.0 to 7.0. More preferred is a pH of 5.0 to 6.0.

Suitable dispersing medium present in the reaction vessel include water and a peptizer. Preferred peptizers include gelatin which can be alkali-treated, acid-treated or derivatized to form acetylated gelatin, phthalated gelatin and the like; proteins and their derivatives; cellulose derivatives such as cellulose esters; polysaccharides such as dextran, gum arabic, zein, casein, pectin, collagen derivatives, agar-agar, arrowroot or albumin. Mixtures of peptizers or peptizer analogues may also be used. The most preferred peptizers are gelatin and gelatin analogues. Other materials commonly employed in combination with hydrophilic colloid peptizers as vehicles (including vehicle extenders such as latices) include synthetic polymeric peptizers, carriers and/or binders such as poly(vinyl lactams) acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine acrylic acid polymers, maleic anhydride copolymers, polyalkylene oxide methacrylamide copolymers, maleic acid copolymers, vinylamine copolymers, methacrylic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides, etc. These additional materials need not be present in the reaction vessel during silver halide precipitation, but can be added to the emulsion prior to coating on a support.

To begin the formation of tabular nuclei, or seed crystals, a soluble silver solution, preferably a silver nitrate solution, is added at a steady rate into the nucleation solution to obtain a ripening pBr level of 0.780 to 1.25. More preferred is a ripening pBr level of 0.78 to 1.0 and most preferred is a ripening pBr level of 0.78 to 0.84. Below a ripening pBr of 0.780, tabular grains are no longer formed. Above a ripening pBr of 1.25 the advantages taught herein are not observed. Ammoniacal base is added to the nucleation solution at the ripening point which corresponds to the time at which 0.30 to 9.0% of the total silver has been added to the reaction vessel. Preferably the ammoniacal base is added to the nucleation solution when 0.30 to 3.0% of the total silver has been added. Suitable ammonium bases include aqueous ammonia and the like. While not restricted to any theory, it is believed that the combination of low pBr, or high bromide concentration, and early addition of ammoniacal base provides an extremely effective solvent system which virtually eliminates the formation of new seeds during the growth phase. This benefit is unexpected in light of the combined disclosures of U.S. Pat. No. 4,914,014, U.S. Pat. No. 4,801,522 and U.S. Pat. No. 4,722,886 from which a higher pBr and later ammonia addition would be expected to be preferred.

B) Ostwald Ripening

Upon achieving the ripening pBr, the flow of silver nitrate solution ceases which signifies the initiation of the Ostwald ripening phase. No additional ingredients are required to be added. The ripening is allowed to continue for a period of up to 60 minutes with 1 to 10 minutes being preferred and 4 to 8 minutes being most preferred.

C) Growth

Immediately following Ostwald ripening is grain growth. It is imperative, as mentioned above, that substantially no new nuclei are formed during the grain growth. The pBr is typically lower during ripening than that required for growth and it is usually preferable to increase the pBr for growth of the tabular grains. This stage which is the initial part of growth is referred to as an adjust portion. The adjustment is typically accomplished by addition of soluble silver solution only. Under the inventive conditions it is most preferable that the silver flow rate increase with time. This is a distinct advantage not readily available in the art. The rate of increase is dependant on equipment, dilution, kettle size and configuration and other parameters. The highest rate of increase obtainable is preferred. It is most preferred that the rate of increase for the flow rate be as high as possible but it is imperative that the flow rate not be so high as to cause new nuclei formation, or reseeding. Upon achieving the maximum flow rate the flow rate is maintained throughout the remainder of the growth phase. Within the teachings of the current invention, a constant silver solution flow rate during the adjust portion increases the size distribution of the resulting grains.

Upon reaching the growth pBr, the flow of halide solution initiates at a rate which will maintain the growth pBr. The initial part of the growth is an adjust portion wherein silver is added to adjust pBr to the growth value. Tabular grain growth is preferred accomplished at a pBr is 1.3 to 2.3 and more preferably at a pBr of 2.0 to 2.3. The silver nitrate flow and halide salt flow are maintained in concert throughout the remainder of the growth phase. Throughout growth it is preferable to continually increase the flow rate of the silver solution up to the practical limit of the equipment or until reseeding occurs as detailed above. The preferred method is to increase the silver flow at a predetermined rate and change the halide flow based on the deviation of the bromide concentration, or pBr. This is typically done by a feed-back loop wherein the pBr measurement controls the flow rate of the salt solution, as known in the art. By way of example, the rate of addition of the halide is increased if the pBr level rises above a predetermined level. The addition rate of the halide is decreased if the pBr level decreases below a predetermined level.

After completion of the growth phase, the pH of the solution can be lowered by the addition of a suitable acid such as sulfuric acid, acetic acid, nitric acid, hydrochloric acid, or the like. Acetic acid is most preferred. The pH to be achieved is, preferably, in the range of about 5.0 to 7.). Although neither necessary, nor preferred within the teachings herein, the grains can be further ripened for a time of 1 to 20 minutes by the addition of a thiocyanate salt to the emulsion. Useful thiocyanate salts include alkali metal thiocyanates and ammonium thiocyanate, e.g. in an amount of 0.1 to 20 g salt/mole silver halide. Other ripening agents include thioether, etc., as well as others known to those skilled in the art.

The tabular grains are preferably washed to remove soluble salts. Washing techniques are known to those skilled in the art. The washing is advantageous in terminating ripening of the tabular grains and to avoid increasing the grain thickness or altering the grain dimensions. While substantially all the grains are tabular in form, the emulsion is not affected by the presence of a minor amount of non-tabular grains. Tabular grains of any aspect ratio can be made according to the described process. Large, thin tabular grains, or thick, small tabular grains can be prepared. It is known in the art that grain size can be controlled by the initial seeding flow rate and temperature. Likewise, the thickness can be controlled by the pBr or ammonia concentration in the kettle.

The teachings herein are applicable to any size tabular grain commonly employed in photographic elements. Small grains, such as less than 1.0 $\mu m^3$ can be prepared rapidly with narrow size distribution. The greatest advantage taught herein is the applicability to large grains such as 1.0 $\mu m^3$, or greater, with a size distribution of 2.00 or less. The total time required for growth is preferably less than 100 minutes and more preferably less than 80 minutes.

CONVENTIONAL EMULSION ADDITIVES

The emulsion containing tabular grains prepared according to this invention is generally fully dispersed and bulked up with gelatin or other dispersion of peptizer as described above. The emulsion is optimally sensitized as known in the art to achieve the appropriate spectroscopic response to actinic radiation. Preferred chemical sensitizers include sulfur and gold as known in the art. Other chemical sensitizers include selenium, tellurium, platinum, palladium, iridium, osmium, rhodium, rhenium, phosphorous or combinations thereof as known in the art. Chemical sensitizers are typically added at a pAg of 8 to 10, a pH of 6.0 to 7.0 and a temperature of 50° to 60° C., although these levels can be different under some sensitizing conditions. In addition to chemical sensitizers, various modifiers can be added including compounds know to decrease fog or increase speed as known in the art. Exemplary examples include azaindenes, azapyridanzines, azapyrimidines, benzothiazolium salts, and sensitizers having one or more heterocyclic nuclei. It is typically preferred to spectrally sensitize tabular grain silver halide emulsion as known in the art. Useful sensitizing dyes are those that sensitize in the blue, green, red and infrared portions of the electromagnetic region. Particularly useful dyes are taught in U.S. Pat. No. 4,424,426 and U.S. Pat. No. 5,108,887.

Grain size dispersities of a tabular grain can be described by measuring $V_{sig}g^o$ which is essentially [1 plus (standard deviation of the volumes/mean volume)] and which is measured by apparatus similar to that taught by Holland et.al. P.S and E, Volume 17, No. 3 (1973), page 295 et seq.

Photographic emulsions which may be considered applicable to the teachings herein include, but are not limited to, positive and negative working systems. Other adjuvants may be added to the photographic emulsion as known in the art including, but not limited to, chemical and spectral sensitizers, brighteners, antifoggants and stabilizers, color materials, light scattering and absorbing materials, other binder additives, other hardeners, coating aids, plasticizers and lubricants, antistatic agents and layers, matting agents, development agents, development modifiers and the like as detailed in *Research Disclosure,* December 1989, Item 308119. It is typical to coat the photographic emulsion on a suitable support, followed by drying, exposing, processing and the like as reviewed in detail in *Research Disclosure,* December 1989, Item 308119. Silver halide emulsions taught herein are typically coated, as known in the art, on a conventional support such as polyethylene terephathalate or the equivalent thereof with a subbing layer as known in the art. It is preferable to coat an antiabrasion layer supra to the emulsion to provide protection as known in the art.

EXAMPLES

The following illustrative examples further elaborate on the teachings herein and are not intended to limit the scope of the present invention. All percentages are by weight unless otherwise noted. N means normal.

A nucleation solution was prepared for each example by adding approximately 8750 grams of distilled water, approximately 140 grams of gelatin, and approximately 176 grams of potassium bromide to a standard emulsion kettle. The mixture was heated to approximately 60° C. A solution of 3N silver nitrate was added at a flow rate of approximately 5.2 ml/minute until the pBr level indicated in Table 1 was achieved. At a predetermined point ammonium hydroxide was added as indicated in Table 1. The nucleation solution was then allowed to Ostwald ripen for the time as specified in Table 1. At the end of the Ostwald ripen phase, the silver flow began, signifying the initiation of the adjust portion of the growth phase. During the adjust portion, two different conditions were utilized. One was a constant silver flow rate of 5.2 ml/min. until the growth pBr was obtained. In Table 1, a constant silver flow during the adjust portion is represented by an adjust portion flow of CON. The second condition involved increasing the silver nitrate flow rate from an initial rate of 5.2 ml/min. The rate of increase was 1.7 ml/min/min from the beginning of silver nitrate flow. In Table 1 this is signified by an adjust portion flow of RAMP. At the point where the growth pBr was obtained, the halide salt flow began and the flow rate of the silver nitrate was increased at a rate of 1.7 ml/min/min up to controllable mechanical limit of the specific equipment used. This typically was 97 ml/min, although this could be different depending on the equipment. The halide salt flow was substantially 1.7 ml/min/min as well, although this is allowed to fluxuate slightly to maintain a constant pBr level in the kettle. At the end of emulsion grain growth, the pH was lowered to approximately 6.0 with acetic acid and the emulsion was washed as known in the art. Upon analysis of the grain size distribution, the observation was made that Samples 1 and 3 comprise two populations of grain size thereby the grain size is bimodal. This is highly undesirable as known in the art and discussed herein. Grain Sample 2 was monodispersed yet the grain size was small. The inventive samples 4 through 8 are all monodispersed as evidenced by the $V_{sig}g^o$, and the grain size is in excess of 1.0 $\mu m^3$. In Table 1, Growth Time represents the total time, in minutes, from the initiation of the growth phase to the end of silver salt and halide salt addition. Ripen Time represents, in minutes, the time from the beginning of the ripen to the beginning of the growth phase.

TABLE 1

Preparation Parameters for Improved Manufacture of Tabular Grains

| SAMPLE | Ammonia Addition % Ag | Ripen pBr | Adjust Portion pBr | Adjust Portion Flow | Growth Time | Ripen Time | V(50) | $V_{sig}g^o$ |
|---|---|---|---|---|---|---|---|---|
| 1 Control | 9.4 | 1.27 | 0.23 | CON | 140 | 3 | 1.28 | 2.13 |
| 2 Control | 9.4 | 1.27 | 0.23 | RAMP | 78 | 3 | .808 | 1.79 |
| 3 Control | 1.5 | .824 | .824 | CON | 140 | 3 | 1.60 | 2.53 |
| 4 Inv. | 3.1 | 0.88 | 0.88 | RAMP | 89 | 7 | 1.17 | 1.79 |
| 5 Inv. | 1.5 | .824 | .824 | RAMP | 78 | 3 | 1.09 | 1.80 |
| 6 Inv. | 0.78 | .798 | .798 | RAMP | 75 | 7 | 1.65 | 1.70 |
| 7 Inv. | 1.5 | .824 | .824 | RAMP | 75 | 7 | 1.36 | 1.72 |
| 8 Inv. | 0.4 | .785 | .785 | RAMP | 75 | 7 | 2.60 | 1.82 |

We claim as our invention:

1. A method for manufacturing tabular silver halide grains comprising the steps of:
   a) forming a nucleation solution by adding aqueous soluble silver salt to a vessel containing 0.08 to 0.25 molar aqueous soluble halide salt in an aqueous dispersion medium whereby from 0.30 to 9.0% by weight of the total amount of the soluble silver salt is added in step (a) and the nucleation pBr is at least 0.78 and no more than 1.0;
   b) adding a solution of ammoniacal base to said nucleation solution when 0.30 to 9.0% by weight of said soluble silver salt has been added;
   c) adding said soluble silver salt to said nucleation solution to obtain growth pBr of 1.3 to 2.3;
   d) adding said soluble silver salt and said soluble halide salt to grow said tabular grains whereby tabular grains are formed having a volume of at least 1.0 $\mu m^3$ and a size distribution of no more than 2.0 $V_{sig}g^o$.

2. A method for manufacturing tabular silver halide grains as recited in claim 1 wherein said aqueous dispersion medium in step (a) comprises 0.1 to 0.2 molar halide salt.

3. A method for manufacturing tabular silver halide grains as recited in claim 1 wherein said ammoniacal base in step (b) is added to said nucleation solution when 0.30 to 3.00% by weight of said soluble silver salt has been added.

4. A method for manufacturing tabular silver grains as recited in claim 1 wherein ripening of said nucleation solution takes place between steps (b) and (c) for a time period not greater than 60 minutes.

5. A method for manufacturing tabular silver halide grains as recited in claim 4 wherein said ripening is more than 1 minute and no more than 10 minutes.

6. A method of claim 1 wherein the addition of step (c) is at an increasing rate of addition.

7. The method for manufacturing tabular silver halide grains recited in claim 1 wherein said nucleation pBr is at least 0.78 and no more than 0.84.

8. A method for manufacturing tabular silver halide grains wherein said tabular silver halide grains are at least 1.0 $\mu m^3$ with a size distribution of no more than 2.0 $V_{sig}g^o$; wherein formation of said tabular silver halide grains comprise the steps of:
   a) forming a nucleation solution by adding aqueous soluble silver salt to a vessel containing 0.08 to 0.25 molar aqueous soluble halide salt in an aqueous dispersion medium;
   b) adding a solution of ammoniacal base to said nucleation solution when 0.30 to 9.0% by weight of said soluble silver salt has been added;
   c) ripening said nucleation solution at a pBr level of no less than 0.780 and no more than 1.0;
   d) adding said soluble silver salt to said nucleation solution at an increasing rate to obtain growth pBr of 1.3 to 2.3;
   e) adding said soluble silver salt and said soluble halide salt to grow said tabular grains.

9. A method for manufacturing tabular silver halide grains as recited in claim 8 wherein said ammoniacal base is added to said nucleation solution when 0.30 to 1.95% of said soluble silver salt has been added.

10. A method for manufacturing tabular silver halide grains as recited in claim 8 wherein said ripening of said nucleation solution is at a pBr level of no less than 0.78 and no more than 1.0.

11. A method for manufacturing tabular silver halide grains comprising the steps of:
   a) forming a nucleation solution by adding soluble silver salt to a vessel containing an aqueous dispersion medium and 0.08 to 0.25 molar halide salt to obtain a nucleation pBr of at least 0.78 and no more than 1.0;

b) adding a solution of ammoniacal base to said nucleation solution when 0.30 to 9.0% of said soluble silver salt has been added;

c) ripening said nucleation solution for up to 60 minutes;

d) adding said soluble silver salt to said nucleation solution at an increasing rate to obtain growth pBr of 1.3 to 2.3;

e) simultaneously adding said soluble silver salt and said soluble halide salt to grow said tabular grain.

12. The method recited in claim 11 wherein said tabular silver halide grains are formed having a volume of at least 1.0 $\mu^3$ and a size distribution of no more than 2.0 $V_{sig}g^o$.

13. A photographic element comprising a support and a layer coated on said support wherein said layer contains a multiplicity of tabular silver halide grains wherein the formation of said tabular silver halide grains comprises the steps of:

a) forming a nucleation solution by adding soluble silver salt to a vessel containing an aqueous dispersion medium and 0.008 to 0.25 molar halide salt to obtain a nucleation pBr of at least 0.78 and no more than 1.0;

b) adding a solution of ammoniacal base to said nucleation solution when 0.30 to 9.0% of said soluble silver salt has been added;

c) ripening said nucleation solution for up to 60 minutes;

d) adding said soluble silver salt to said nucleation solution at an increasing rate to obtain growth pBr of 1.3 to 2.3;

e) simultaneously adding said soluble silver salt and said soluble halide salt to grow said tabular grain;

and said tabular silver halide grains consist essentially of a size of at least 1.0 $\mu m^3$ and have a size distribution of no more than 2.0 $V_{sig}g^o$.

* * * * *